US009682579B2

(12) United States Patent
Otsuka

(10) Patent No.: US 9,682,579 B2
(45) Date of Patent: Jun. 20, 2017

(54) MEDIUM TRANSPORTING STATE DETECTING DEVICE AND PRINTING APPARATUS

(71) Applicant: SEIKO EPSON CORPORATION, Tokyo (JP)

(72) Inventor: Shuji Otsuka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/246,048

(22) Filed: Aug. 24, 2016

(65) Prior Publication Data

US 2017/0057256 A1 Mar. 2, 2017

(30) Foreign Application Priority Data

Aug. 25, 2015 (JP) ..... 2015-165386

(51) Int. Cl.

| | |
|---|---|
| ***B41J 11/00*** | (2006.01) |
| ***B41J 13/00*** | (2006.01) |
| *B41J 2/01* | (2006.01) |
| *B41J 11/42* | (2006.01) |

(52) U.S. Cl.

CPC ..... *B41J 13/0009* (2013.01); *B41J 11/0095* (2013.01); *B41J 2/01* (2013.01); *B41J 11/42* (2013.01)

(58) Field of Classification Search

CPC .... B41J 13/0009; B41J 11/0095; B41J 11/42; B41J 2/01

See application file for complete search history.

(56) References Cited

FOREIGN PATENT DOCUMENTS

| | | | | |
|---|---|---|---|---|
| JP | 09-318320 | | 12/1997 | |
| JP | 09-318320 A | * | 12/1997 | ..... G01B 11/00 |
| JP | 2007-278786 | | 10/2007 | |
| JP | 2013-231658 | | 11/2013 | |
| WO | 2015-146193 | | 10/2015 | |

OTHER PUBLICATIONS

HP Designjet Z6100-series Printers: Optical Media Advance Sensor, Mar. 2007 (8 pages).

(Continued)

*Primary Examiner* — Manish S Shah
*Assistant Examiner* — Yaovi M Ameh
(74) *Attorney, Agent, or Firm* — Workman Nydegger

(57) ABSTRACT

A medium transporting state detecting device includes an irradiation optical system which irradiates a sheet-shaped medium with non-coherent light, a light receiving optical system which receives diffuse reflected light from the medium, a diffuse reflected light acquisition unit which acquires an intensity of the diffuse reflected light for each constant period;, a frequency component analyzing unit which performs analyzing a frequency component of reflected light intensity arrays where the intensity is temporally and sequentially shifted, a period calculating unit which obtains an actual period of a temporal change in a real number portion of a frequency component of a specified frequency among the analyzed frequency components, and a velocity detecting unit which obtains at least one of a difference between an actual velocity and a target velocity and the actual velocity based on the actual period and the target period.

8 Claims, 6 Drawing Sheets

(56) References Cited

OTHER PUBLICATIONS

Atsushi Takaura, Development of Laser Speckle-Based Displacement Sensor with High Accuracy, Jan. 2014 (30 pages).
Nakamura, Yukito et al., The Development of High Response Speckle Velocimeter (26 pages), Konica Technical Report vol. 4, Jan. 1991.
Haruna Masamitsu, Optical Coherence Tomography (OCT), Medical Photonics No. 1, (25 pages).

* cited by examiner

S110
P
VA
ts
TRANSPORTING DIRECTION
INTENSITY
TIME

T = n·ts
1
n
Td = p·ts(1 ≤ p < n)
D(1)
D(2)
D(m)

S120
FREQUENCY COMPONENT ANALYZING (FFT)
Re[fc(i)](i = 1 TO m)
fq = q·Δf (q:1,2,3,···)
Δf = fs/n (fs = 1/ts)
f1 f2 f3 f4 f5
FREQUENCY
INTENSITY

FIG. 5
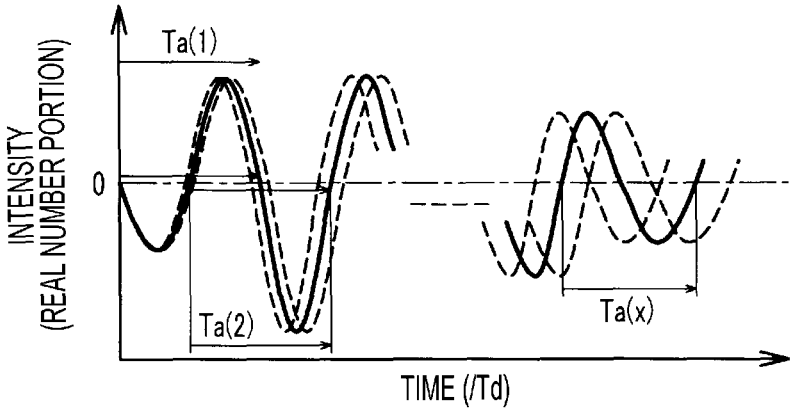
FIG. 6
| RELATIVE VELOCITY vr = va/v0 | ACTUAL PERIOD (AVERAGE PERIOD) Ta | RELATIVE FREQUENCY DIFFERENCE fdr = (fa − f0)/f0 | CHANGE COEFFICIENT Kca = −(1 − vr)/fdr |
|---|---|---|---|
| 0.98 | 21.686 | −0.00484 | 4.13 |
| 1.00(= v0) | 21.581(=T0) | 0 | 0 |
| 1.02 | 21.466 | +0.00536 | 3.37 |
FIG. 7
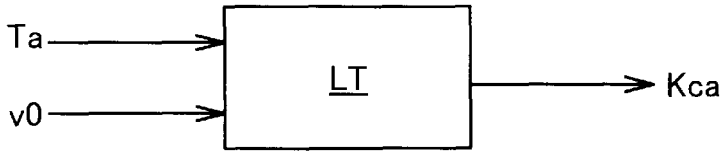
$$Kca = -(1 - vr)/fdr \quad \cdots(3)$$
$$fdr = (fa - f0)/f0 \quad \cdots(4)$$

$$Kcb = -(1 - vr) \quad \cdots(6)$$

$$\Delta va = v0 \cdot Kcb \quad \cdots(5)$$
$$Kcb = -(1 - vr) \quad \cdots(6)$$

$$Kr = vr = va/v0 \quad \cdots(9)$$

$$va = v0 \cdot Kr \quad \cdots(7)$$
$$Kr = vr = va/v0 \quad \cdots(9)$$

MEDIUM TRANSPORTING STATE DETECTING DEVICE AND PRINTING APPARATUS

BACKGROUND

1. Technical Field

Embodiments of the present invention relate to a medium transporting state detecting device and a printing apparatus provided with the device.

2. Related Art

In a printing apparatus that is configured for transporting a sheet shaped medium (paper or film), a method for detecting medium displacement (transporting amount) by analyzing data of an image imaged on a sheet-shaped medium to be transported (also referred to as a "real image capturing method") is known as disclosed in JP-A-2013-231658, for example.

In the real image capturing method of JP-A-2013-231658, it is problematic to increase a velocity of repeating the imaging. A more serious problem is increasing a transporting velocity. To solve these problems, one may consider widening an imaging area and capturing a high-definition image. However, this leads to the problem of increasing the size and the cost of an imaging device and an optical system device needed to acquire the image and increase the transporting velocity. In addition, even if a configuration in which the imaging area is widened and the definition of the captured image is increased can be achieved corresponds to an increase in the transporting velocity, it is necessary to further increase the size and the cost of the device. Further, there is a limit to widening the imaging area and to increasing the definition of the captured image. Therefore, further improvements are desired in devices for detecting a displacement of a sheet-shaped medium (paper or film).

SUMMARY

Embodiments of the invention can be realized in the following aspects or application examples.

(1) According to an aspect of the invention, a medium transporting state detecting device is provided. The medium transporting state detecting device includes an irradiation optical system which irradiates a sheet-shaped medium to be transported with non-coherent light. A light receiving optical system receives diffuse reflected light of the non-coherent light from the medium. A diffuse reflected light acquisition unit acquires an intensity of the diffuse reflected light for each constant period. A frequency component analyzing unit analyzes a frequency component for each of a plurality of reflected light intensity arrays configured of arrays of an intensity in a time period where the intensity is temporally and sequentially shifted, among the intensities of the diffuse reflected light which are acquired over a plurality of periods. A period calculating unit obtains an actual period of a temporal change in a real number portion of a frequency component of a specified frequency among the analyzed frequency components. A velocity detecting unit obtains at least one of a difference between an actual velocity of the medium and a target velocity and the actual velocity based on the actual period and the target period which is a period of the temporal change in the real number portion of the frequency component of the specified frequency in a case where a transporting velocity of the medium is the target velocity.

According to this aspect, the problems of increasing the size and the cost of the imaging device and optical device previously described can be solved, the transporting velocity (actual velocity) of the sheet-shaped medium can be obtained and the changes in the transporting velocity can be detected. The structure is simpler compared to the related art.

(2) In the medium transporting state detecting device according to the aspect, the velocity detecting unit may obtain the difference between the actual velocity and the target velocity based on the target period and the actual period and correct the target velocity by the difference to obtain the actual velocity.

According to this aspect, with a simpler structure as compared to the related art, the difference between the actual velocity and the target velocity of the sheet-shaped medium can be obtained and the actual velocity can be obtained by correcting the target velocity by the difference.

(3) In the medium transporting state detecting device according to the aspect, the velocity detecting unit may include a look-up table which receives the target velocity and the actual period as input and outputs a correction coefficient in accordance with the target velocity and the actual period and may obtain the difference between the actual velocity and the target velocity, or the actual velocity by a calculation using the correction coefficient and the target velocity.

According to this aspect, the difference between the actual velocity and the target velocity or the actual velocity can be easily obtained by the calculation using the target velocity and the correction coefficient output from the look-up table which receives the input of the target velocity and the actual period.

(4) In the medium transporting state detecting device according to the aspect, the velocity detecting unit may include a look-up table which receives the target velocity and the actual period as input and outputs the difference between the actual velocity and the target velocity, or the actual velocity.

According to this aspect, the difference between the actual velocity and the target velocity or the actual velocity can be easily obtained from the look-up table which receives the input of the target velocity and the actual period.

(5) According to another aspect of the invention, a printing apparatus is provided. The printing apparatus includes the medium transporting state detecting device according to any one of the above aspects and a printing section which performs printing on the medium.

Embodiments of the invention may be implemented by a variety of aspects other than the medium transporting state detecting device, for example, a medium transporting state detection method, a medium transporting apparatus, a medium transporting controlling apparatus, a medium transporting control method, and a variety of electronic equipment such as a printing apparatus provided with the medium transporting state detecting device.

BRIEF DESCRIPTION OF THE DRAWINGS

Embodiments of the invention will be described with reference to the accompanying drawings, wherein like numbers reference like elements.

FIG. 5 is an explanatory diagram illustrating a method for calculating an actual period to be executed by a period calculating unit.

FIG. 6 is a table illustrating an example of a relationship between an actual period, a relative frequency difference, and a change coefficient corresponding to a relative velocity.

FIG. 7 is an explanatory diagram illustrating an example of a look-up table in which the change coefficient is stored as a correction coefficient.

DESCRIPTION OF EXEMPLARY EMBODIMENTS

Figure 1:
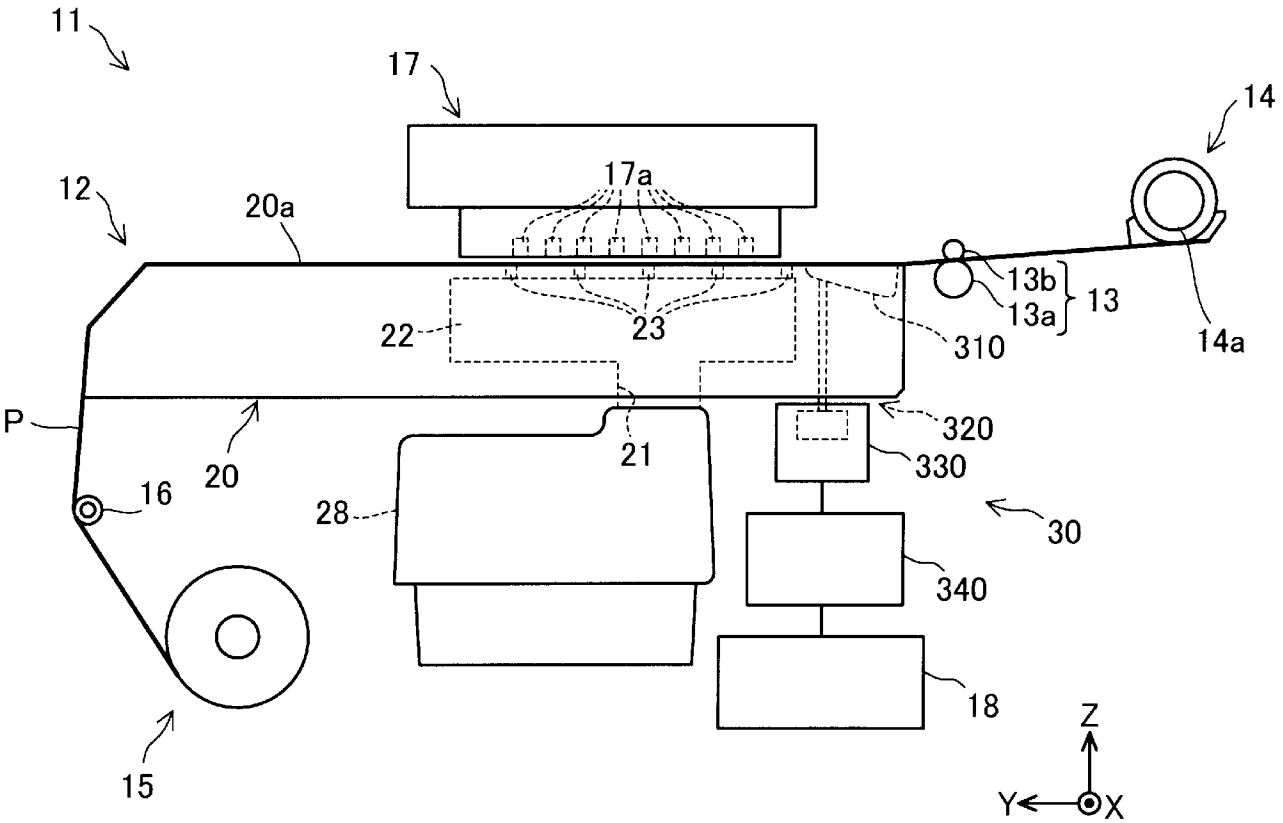
FIG. 1 is a schematic configuration diagram of an ink jet printer according to an embodiment.

A. Configurations of a Printing Apparatus and Medium Transporting State Detecting Device FIG. 1 is a schematic configuration diagram of an ink jet printer according to an embodiment. The ink jet printer (hereinafter, simply referred to as a "printer") 11 which is as an example of a printing apparatus includes a transporting device 12. The transporting device 12 transports a long sheet-shaped continuous paper P which is an example of a sheet-shaped medium. The printer 11 includes an ejection unit 17 which is an example of a printing unit which performs printing by ejecting an ink with respect to the continuous paper P to be transported by the transporting device 12. In addition, the printer 11 includes a control unit 18 which controls the transporting device 12 and the ejection unit 17.

The transporting device 12 includes a feeding unit 14 which feeds the continuous paper P and a winding unit 15 which rewinds the continuous paper P which is fed from the feeding unit 14 and in which the printing is performed by the ejection unit 17. In FIG. 1, the feeding unit 14 is disposed in a right side position which is an upstream side of the continuous paper P in a transporting direction Y (left direction of FIG. 1) and the winding unit 15 is disposed at a left side which is a downstream side thereof.

The ejection unit 17 is disposed at a position between the feeding unit 14 and the winding unit 15 so as to face the transporting path of the continuous paper P. A plurality of nozzles 17*a* for ejecting the ink onto the continuous paper P are disposed in a surface of the ejection unit 17 facing the transporting path of the continuous paper P.

In addition, in the transporting device 12, a medium supporting unit 20 which supports the continuous paper P is disposed in a position facing the ejection unit 17 and across the transporting path of the continuous paper P. The medium supporting unit 20 is formed in a bottomed square box shape which is provided with a mouth portion 21 at a bottom surface side which is an opposite side of the side of the medium supporting unit 20 facing the ejection unit 17.

A suction fan 28, which is an example of a suction unit for sucking an air in an internal space 22 of the medium supporting unit 20, is provided at the lower surface of the medium supporting unit 20, so as to cover the mouth portion 21. A surface of the medium supporting unit 20 facing the ejection unit 17 is a horizontal support surface 20*a* for supporting the continuous paper P to be transported. The medium supporting unit 20 is provided with a plurality of suction holes 23 for adsorbing or sucking the continuous paper P to the support surface 20*a*. Each suction hole 23 is communicated with the internal space 22 of the medium supporting unit 20. According to such a configuration, a negative pressure is applied to a space between the continuous paper P and the medium supporting unit 20 through the internal space 22 and the suction hole 23 by the suction fan 28 in a manner that the suction fan 28 is rotated and driven as to cause the mouth portion 21 to suck the air as an suction port. The suction fan 28 sucks the air out of the internal space 22 so as to suck the continuous paper P to the surface of the medium supporting unit 20 facing the ejection unit 17. Accordingly, a suction power for absorbing or sucking the continuous paper P to the support surface 20*a* is applied to the continuous paper P.

A medium transporting state detecting device 30 for detecting a transporting amount of the continuous paper P is attached to a lower portion of the medium supporting unit 20 at an upstream side in relation to the internal space 22 with which a plurality of the suction holes 23 is communicated. The medium transporting state detecting device 30 is configured to determine at least how much the continuous paper P is transported and/or the transporting velocity and is located upstream of the suction holes 23 in one example.

The medium transporting state detecting device 30 includes an irradiation optical system 310 which irradiates the continuous paper P with non-coherent illumination light, a light receiving optical system 320 and a light receiving circuit 330 for receiving the diffuse reflected light of the illumination light from the bottom surface of the continuous paper P. The medium transporting state detecting device 30 also includes the transporting state detecting unit 340. The medium transporting state detecting device 30 detects changes in the transporting state such as the velocity and changes in the velocity of the continuous paper P based on the changes in an intensity of the diffuse reflected light of the non-coherent illumination light which is radiated onto the bottom surface (non-printing surface) of the continuous paper P to be transported, as described in detail below.

A feeding shaft 14*a* extending in a width direction X of the continuous paper P which is a direction perpendicular to the transporting direction Y of the continuous paper P (in FIG. 1, a direction perpendicular to the paper surface) is rotatably provided in the feeding unit 14. In the feeding shaft 14*a*, the continuous paper P is integrally rotatably supported by the feeding shaft 14*a* in a state where the continuous paper P is wound in a roll shape in advance. By rotating the feeding shaft 14*a*, the continuous paper P is fed toward the downstream side of the transporting path from the feeding shaft 14*a*.

A sheet feed roller pair 13 which is an example of a transporting unit which guides the continuous paper P to be transported from the feeding shaft 14*a* to the support surface 20*a* while pinching the continuous paper P is disposed downward and leftward from the feeding shaft 14*a* I none example. The sheet feed roller pair 13 is disposed in or before an upstream side end portion of the medium supporting unit 20 in the transporting direction Y and at adjacent positions in the transporting direction Y. The sheet feed roller pair 13 includes a sheet feed roller 13*a* which is rotatably provided and a sheet hold roller 13*b* that follows the rotation of the sheet feed roller 13*a*. A position in which the continuous paper P is pinched by the sheet feed roller 13*a* and the sheet hold roller 13*b* is positioned at the upper side from or relative to the support surface 20*a* of the medium supporting unit 20.

A tension roller 16 for adjusting tension of the printed region in the continuous paper P is disposed at the downstream side of the support surface 20*a* in the transporting direction Y in the transporting path of the continuous paper P. The winding unit 15 is disposed at the downstream side of the tension roller 16 in the transporting path of the continuous paper P.

A winding shaft 15*a* extending in a width direction X of the continuous paper P is rotatably provided in the winding unit 15. By rotating the winding shaft 15*a*, the printed continuous paper P to be transported from the tension roller 16 side is sequentially wound by the winding shaft 15*a*.

Figure 2:
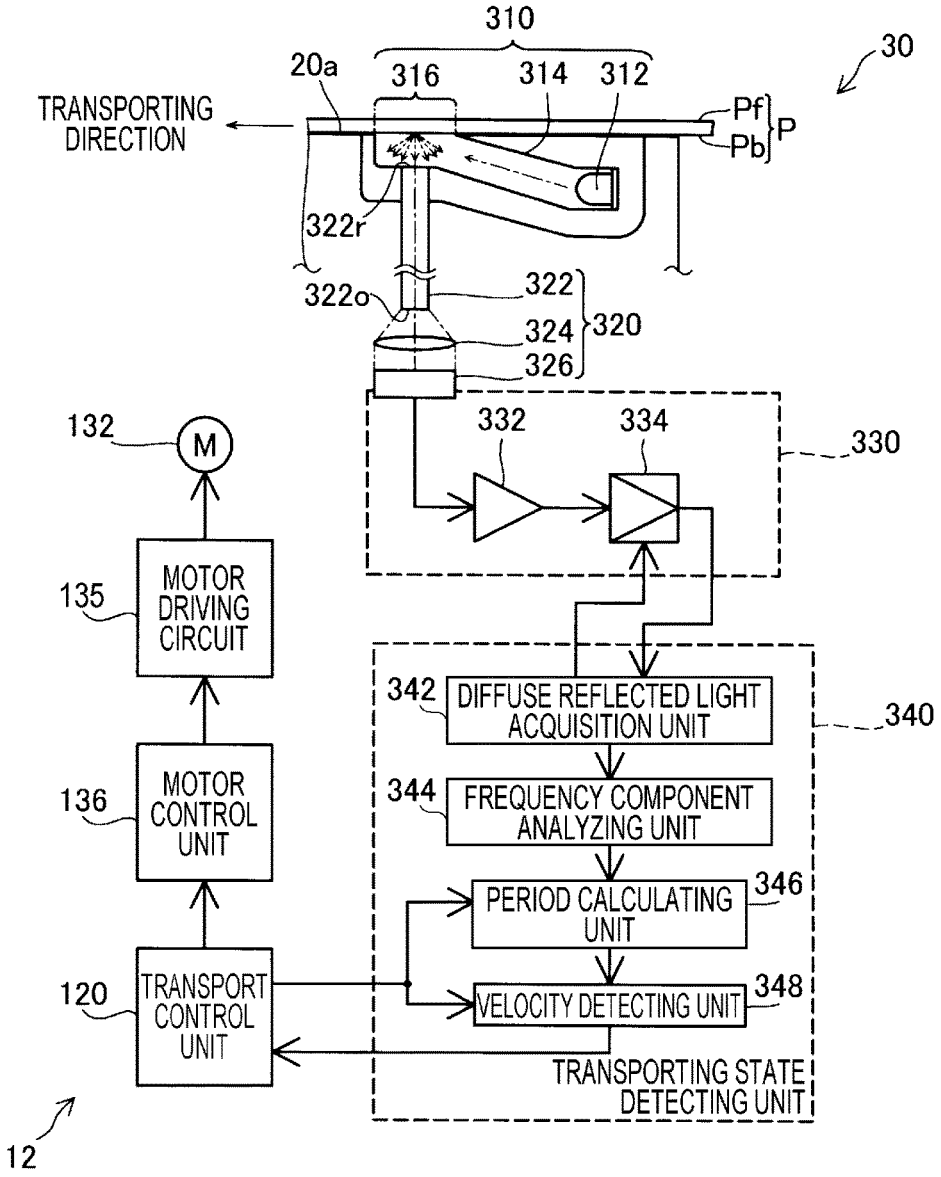
FIG. 2 is a schematic configuration diagram of a medium transporting state detecting device.

FIG. 2 is a schematic configuration diagram of a medium transporting state detecting device 30. As described above, the medium transporting state detecting device 30 includes the irradiation optical system 310 (also referred to as an "irradiation optical system"), the light receiving optical system 320, the light receiving circuit 330, and the transporting state detecting unit 340.

The irradiation optical system 310 includes a light source 312 which emits non-coherent light and a light guide unit 314 which guides the non-coherent light emitted from the light source 312 as the irradiation light such that the bottom surface (non-printing surface) Pb of the continuous paper P is radiated with the non-coherent light. The continuous paper P passes over or past an opening unit 316 which is provided in the support surface 20*a*. As the light source 312, a light emitting diode (LED) which emits the non-coherent light having wavelengths in an infrared region can be used, for example. Hereinafter, the non-coherent irradiation light is simply abbreviated to "irradiation light".

The light receiving optical system 320 includes an optical fiber 322 or an optical conduit, a condensing lens 324, and a photo sensor 326. The optical fiber 322 is disposed so that a light receiving surface 322*r* is in contact with or exposed at the surface of the light guide unit 314 facing the bottom surface Pb of the continuous paper P on the opening unit 316. The light receiving surface 322*r* is disposed in a vicinity of the bottom surface Pb of the continuous paper P through the light guide unit 314. The optical fiber 322 receives the diffuse reflected light of light which is radiated on the continuous paper P by the irradiation optical system 310. The diffuse reflected light is received by or in the light receiving surface 322*r* and the received light is emitted from a light-exit surface 322*o* which is the other end surface of the optical fiber 322. In one embodiment, the irradiation optical system 310 and the light receiving optical system 320 are configured so that the diffuse reflected light is received in the light receiving surface 322*r* and so that mirror-reflected light is not received in the light receiving surface 322*r*. The condensing lens 324 condenses light so that light (diffuse reflected light) emitted from the light-exit surface 322*o* is radiated to a photo sensor 326. The photo sensor 326 converts the intensity of the received light to an electrical signal (hereinafter, also referred to as a "light receiving signal").

The irradiation optical system 310 is fixed in or on the bottom surface side of the support surface 20*a* so that an energy of the diffuse reflected light which is incident to the light receiving surface 322*r* of the optical fiber 322 is not changed by changing the position relationship between the light source 312, the light guide unit 314, and the opening unit 316.

The energy of the diffuse reflected light which is incident to the light receiving surface 322*r* of the optical fiber 322 is lowered as the light receiving surface 322*r* is separated from the sheet surface, and a wider view (a size of a region of the sheet surface of the diffuse reflected light which can be incident) in the light receiving surface 322*r* is obtained. For stably receiving the diffuse reflected light in the light receiving surface 322*r*, it is preferable that a gap (interval) between the light receiving surface 322*r* and the sheet surface is shortened as much as possible in a range that the radiation of the irradiation light from the irradiation optical system 310 to the opening unit 316 is not interrupted. Thus, the light receiving surface 322 is positioned in a range such that the radiation of the irradiation light arrives at the sheet surface without being interrupted.

In addition, the size of the light receiving surface 322*r* of the optical fiber 322 is selected to be a size in which a texture surface on the sheet surface is capable of receiving the light in accordance with the changes in the diffuse reflected light. For example, in common plain paper, a size of a fiber which is configured for a surface asperity of common plain paper is about 1 μm to several μm. It is desirable to detect the asperity as the changes in the diffuse reflected light. The view field is desired to be a range of several tens μm squared to 200 μm squared. In this example, as the optical fiber 322, ϕ100 μm of an optical fiber is used, the gap is set to 1 mm, and the view filed is set to about 100 μm squared. The view field is strictly dependent on the gap between the sheet surface and the light receiving surface 322*r*, and the size of the view field is increased as the size of the gap increases. As described above, from the description that the gap is shortened as much as possible, in one example, a square shape having a side that is the same size as that of the diameter of the optical fiber 322 is described as the view field shape.

The light receiving circuit 330 includes an amplifier 332 and an AD convertor 334. The amplifier 332 amplifies the light receiving signal of the diffuse reflected light from the photo sensor 326 so as to match with an input range of the AD convertor 334. The AD convertor 334 quantizes analog intensity signals of the diffuse reflected light sequentially at a constant sampling interval, converts the quantized signals into digital light receiving signals of the diffuse reflected light based on the sampling signal supplied from the transporting state detecting unit 340, and outputs the converted signal to the transporting state detecting unit 340.

The transporting state detecting unit 340 is a control device configured by a computer system and includes a CPU, a memory such as a ROM and a RAM, an interface, and the like. By reading and executing a program stored in the memory, the transporting state detecting unit 340 serves as a diffuse reflected light acquisition unit 342, a frequency component analyzing unit 344, a period calculating unit 346, and a velocity detecting unit 348.

The diffuse reflected light acquisition unit 342 supplies a sampling signal to the AD convertor 334 and acquires data (diffuse reflected light data) which is output as the digital light receiving signal of the diffuse reflected light output from the AD convertor 334 for each sampling period, sequentially. The diffuse reflected light data represents an output value of the photo sensor 326, that is, an intensity of the diffuse reflected light.

As described below, the frequency component analyzing unit 344 performs analyzing a frequency component for each of a plurality of reflected light intensity arrays configured of arrays of an intensity in a time period where the intensity is temporally and sequentially shifted, among the intensities of the diffuse reflected light which are acquired over a plurality of periods. The value of the diffuse reflected light corresponds to the "intensity of the diffuse reflected light" of the invention, and each of the arrays of a plurality of the diffuse reflected light data pieces corresponds to the "reflected light intensity array" of the invention.

As described below, the period calculating unit 346 obtains a period (hereinafter, referred to as an "actual period") of a temporal change in a real number portion of a frequency component of a specified frequency among the analyzed frequency components analyzed by the frequency component analyzing unit 344.

As described below, the velocity detecting unit 348 detects a change in a real velocity of the continuous paper P (hereinafter, referred to as an "actual velocity") to obtain the actual velocity and the difference between the actual velocity and a target velocity (hereinafter, referred to as a "velocity change") based on the actual velocity and the target velocity which is a period of the temporal change in the real number portion of the frequency component of the specified frequency in a case where a transporting velocity of the continuous paper P is the target velocity. The target velocity is instructed or received from a transport control unit 120 of the transporting device 12. In addition, the result obtained by the velocity detecting unit 348 (at least one of the actual velocity and the velocity change) is supplied to the transport control unit 120 of the transporting device 12.

The transporting state of the continuous paper P causes a motor control unit 136 to be controlled based on the target velocity and the actual velocity or the velocity change which is obtained by the transport control unit 120 of the transporting device 12, and the transporting state is controlled in such a manner that the motor control unit 136 controls an operation of a sheet feed motor 132 via a motor driving circuit 135 to drive the sheet feed roller 13*a* (FIG. 1).

B. Transporting State Detecting Operation of First Embodiment

Figure 3:
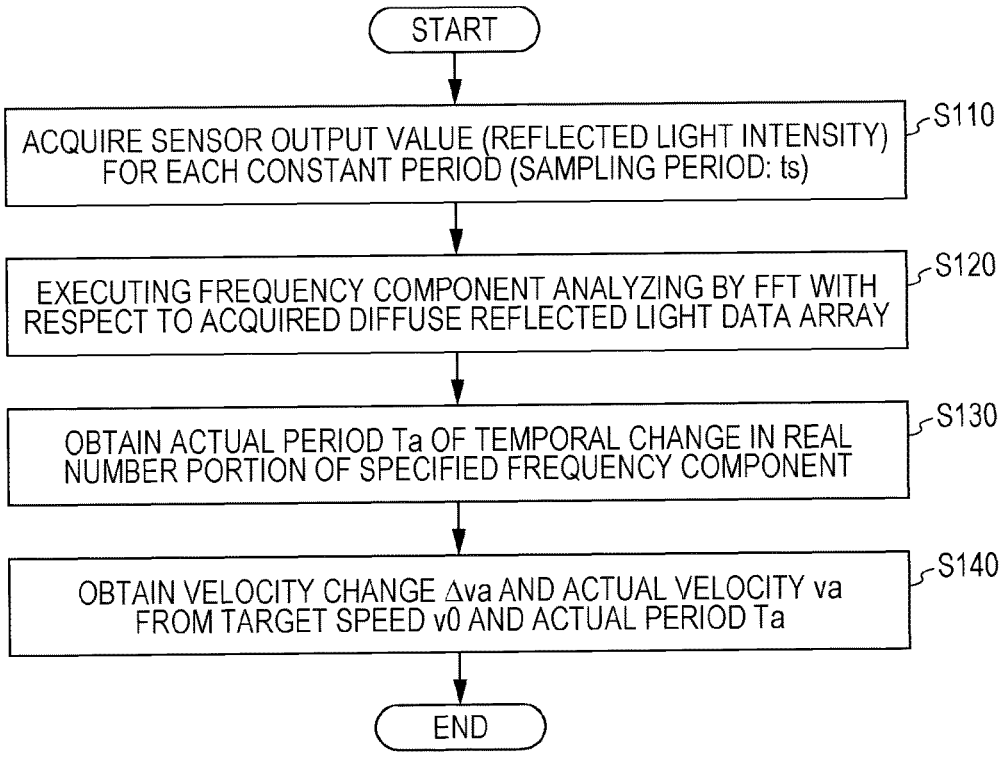
FIG. 3 is a flow chart illustrating a procedure of a transporting state detecting process to be executed by a transporting state detecting unit.

FIG. 3 is a flow chart illustrating a procedure of a transporting state detecting process to be executed by a transporting state detecting unit 340. The transporting state detecting process is repeatedly executed while transporting of the continuous paper P is performed by the transporting device 12.

In Step S110, the diffuse reflected light acquisition unit 342 (FIG. 2) supplies a sampling signal having a sampling period ts to the AD convertor 334 and acquires a sensor output value of the photo sensor 326 which is output for each constant period (sampling period ts) from the AD convertor 334, that is, the diffuse reflected light data indicating the intensity of the diffuse reflected light. The sensor output value is acquired in each sampling period. In Step S120, the frequency component analyzing unit 344 executes analyzing the frequency component by a fast fourier transform (FFT) with respect to the array of the diffuse reflected light data (hereinafter, referred to as a "reflected light intensity array") arranged in time series obtained by the diffuse reflected light acquisition unit 342.

Figures 4A, 4B, 4C:
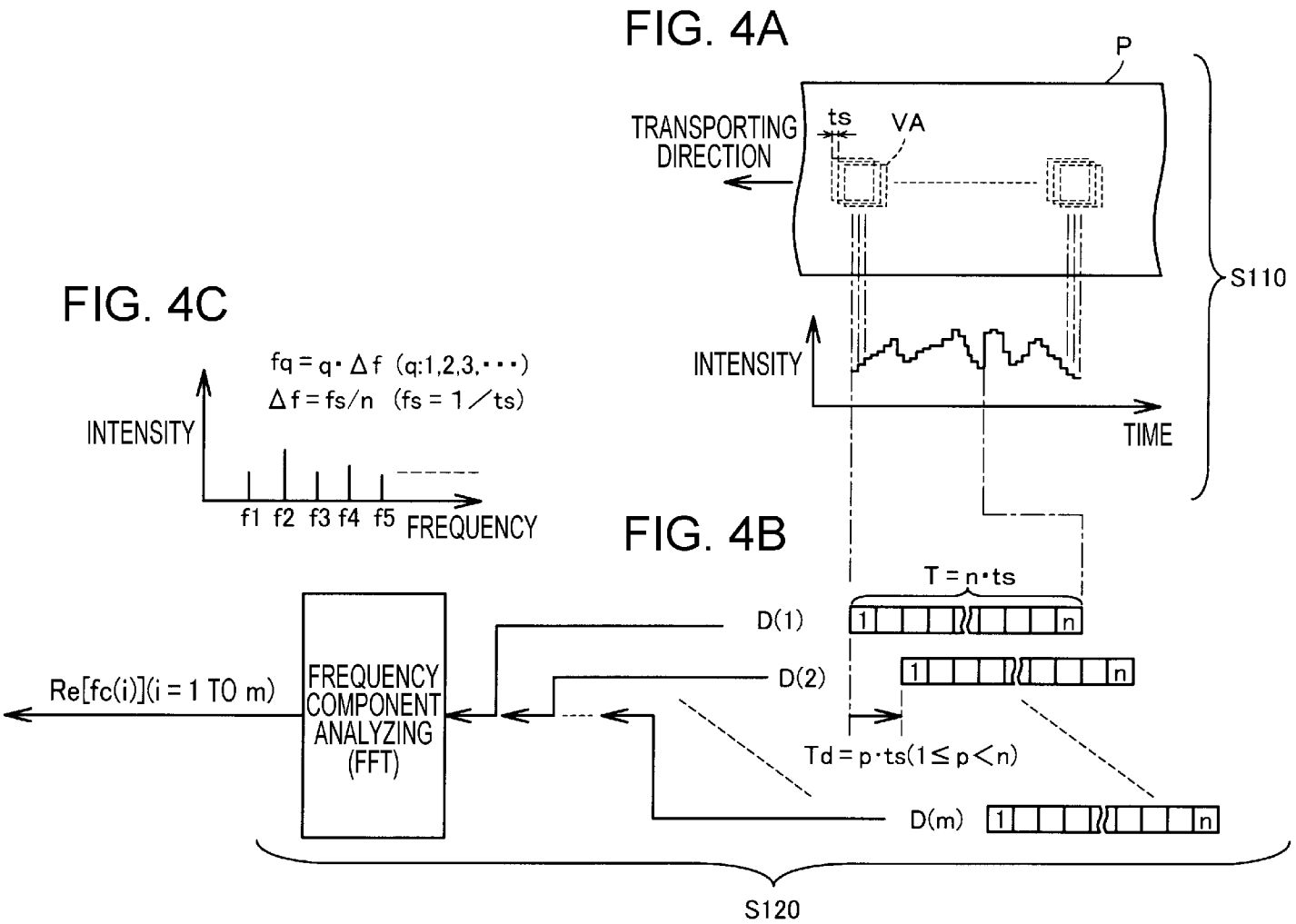
FIGS. 4A to 4C are explanatory diagrams illustrating an acquisition of diffuse reflected light data to be executed by a diffuse reflected light acquisition unit and an analysis of a frequency component to be executed by a frequency component analyzing unit.

FIGS. 4A to 4C are explanatory diagrams illustrating an acquisition of diffuse reflected light data to be executed by the diffuse reflected light acquisition unit 342 and an analysis of a frequency component to be executed by a frequency component analyzing unit 344.

As shown in FIG. 4A and by way of example, when the continuous paper P is set as a standard, a view field VA of the light receiving optical system 320 is sequentially and relatively shifted toward a direction opposite to the transporting direction of the continuous paper P in accordance with the transporting of the continuous paper P. In this case, in Step S110, the diffuse reflected light acquisition unit 342 (FIG. 2) acquires the sensor output value of the photo sensor 326 output from the AD convertor 334 for each sampling period ts, that is, the diffuse reflected light data indicating the intensity of the diffuse reflected light from the continuous paper P corresponding to the view field VA of the light receiving optical system 320. Accordingly, as shown in the graph of FIG. 4A in which a horizontal axis represents a time and the a vertical axis represents an intensity, the diffuse reflected light data pieces are arranged in a time series. The data pieces which are acquired sequentially at the sampling period ts is a data array corresponding to the changes in the intensity of the diffuse reflected light according to the position of the continuous paper P.

In Step S120, the frequency component analyzing unit 344 (FIG. 2) executes analyzing of the frequency component by the FFT as described below. Thus, the frequency component is analyzed.

The frequency component analyzing unit 344 classifies the array of the diffuse reflected light arranged in time series at an interval of the sampling period ts obtained by the diffuse reflected light acquisition unit 342 into a plurality (period several m) of periods of a window width T which is shifted sequentially at a shift width Td, and executes the FFT in a unit of the array of the diffuse reflected light included in each period of the classified window width T as described in below (FIGS. 4B and 4C). The window width T is expressed as a product (n·ts) of the sampling period ts and the sampling number n. The shift width Td is expressed as a product (p·ts) of the sampling period ts and a shift number p. A sampling number n is an integer expressed with a power of two. The shift number p is an integer satisfying an expression of $1 \leq p < n$, a period number m is an integer satisfying an expression of $1 < m < n$, and each number is set based on at least a number required for obtaining the actual period of the temporal change in the real number portion of the frequency component of the specified frequency to be described.

Light intensity arrays D(1) to D(m) are obtained from the sequentially shifted window of width T applied to the array of the diffuse reflected light arranged in time series. The frequency component analyzing unit 344 executes the analyzing of the frequency component by the FFT with respect to reflected light intensity arrays D(1) to D(m) configured of each period, sequentially, for each period of a first period to an m-th period. A graph of FIG. 4C in which a horizontal axis represents a frequency and a vertical axis represents an intensity shows an example of the analyzing result of the frequency in a certain period. In the analyzing of the frequency component by the FFT, a frequency resolution $\Delta f$ is expressed by an expression of $\Delta f = fs/n$. fs is an inverse (1/ts) of the sampling frequency, that is, the sampling period ts. A plurality of frequency components to be analyzed fq ($q = 1, 2, 3, \ldots$) is expressed by an expression of $fq = q \cdot \Delta f$, such as $f1 = \Delta f$, $f2 = 2 \cdot \Delta f$, $f3 = 3 \cdot \Delta f$, . . . .

Among the analyzing results in each period of the window width T from the first period to the m-th period, a real number portion Re[fc(i)] (i=1 to m) of the specified frequency component fc which is set in advance in accordance with the texture on the continuous paper P is used as the analyzing result.

In Step S130 of FIG. 3, the period calculating unit 346 (FIG. 2) obtains the period of a periodic temporal change (hereinafter, referred to as an "actual period") Ta which is generated in the real number portion Re[fc(i)] of the specified frequency component fc obtained as the analyzing result.

FIG. 5 is an explanatory diagram illustrating a method for calculating an actual period Ta to be executed by the period calculating unit 346. FIG. 5 shows a state where the real number portion Re[fc(i)] (i=1 to m) of the specified frequency component fc is plotted on a graph in which a horizontal axis represents a time and a vertical axis represents an intensity of the real number portion. The position of the horizontal axis of each real number portion is an interval of the shift width Td. The temporal change in the real number portion Re[fc(i)] of the specified frequency component fc in each period of the first period to the m-th period is a periodic change shown in FIG. 5. As a period of the real number portion Re[fc(i)] of the specified frequency component fc, all of the periods which are capable of being measured are measured while shifting in a constant time unit (for example, a half period) starting from a start point of a period measurement sequentially, to obtain a plurality of periods Ta(1), Ta(2), . . . Ta(x). x is an integer of 2 or more which is preset depending on the specified frequency component fc. An average value [Ta((1)+T(2)+ . . .Ta(x))/x] of the measured plurality of periods Ta(1), Ta (2), . . .Ta(x) is calculated, and the average value is set to the actual period Ta of the temporal change in the real number portion of the specified frequency fc. In the measurement of the plurality of periods, the starting point of the period measurement may be set a point shifting in a period unit without the half period unit. However, for stably obtaining the actual period Ta by increasing the sampling number for calculating the average period, it is preferable that the starting point is set to the half period unit.

Here, the inventor of the present application found that the temporal change in the real number Re[fq(i)] of each frequency component, which is obtained by analyzing the frequency, periodically varies as shown by solid line curves and dot line curves of FIG. 5, and that the variation period is changed according to the transporting velocity of the continuous paper P to be transported (sheet-shaped medium). Specifically, if the transporting velocity increases, the variation period becomes shorter, and if the transporting velocity decreases, the variation period becomes longer. According to this, the inventor found that as described below, the difference (velocity change) Δva between the actual velocity va and the target velocity v0 and the actual velocity va can be obtained based on the actual period Ta of the temporal change in the real number portion Re[fc(i)] of the specified frequency component fc and the set transporting velocity (hereinafter, referred to as a "target velocity") v0. And, according to this, the changes in the transporting velocity can be detected.

The actual velocity va can be represented by Expression (1) below.

$$Va=v0+\Delta va \quad (1)$$

Here, v0 represents a target velocity, and the transporting device 12 drives the medium according to the target velocity v0.

The inventors of the present application found that the velocity change Δva can be represented by Expression (2) below.

$$\Delta va=v0\cdot Kca\cdot fdr \quad (2)$$

Kca is a change coefficient stored as a correction coefficient represented by Expression (3) below, and fdr is a relative frequency difference represented by Expression (4) below.

$$Kca=-(1-vr)/fdr \quad (3)$$

$$fdr=(fa-f0)/f0 \quad (4)$$

Here, vr is a relative velocity that is a ratio (va/v0) of the actual velocity va with respect to the target velocity v0, and −(1−vr) means a relative velocity difference [(va−v0)/v0] which is obtained by dividing the velocity change Δva(=va−v0) which is a difference between the actual velocity va and the target velocity v0 by the target velocity v0.

In addition, fa is a frequency represented by an inverse 1/Ta of the actual period Ta (hereinafter, referred to as the "actual frequency") and f0 is a frequency (hereinafter, referred to as a "target frequency") represented by an inverse 1/T0 of a period (hereinafter, referred to as a "target period") T0 of a periodic temporal change which is generated in the real number portion Re[fc(i)] of the specified frequency component fc in a case where the transporting velocity of the continuous paper P is a target velocity v0. The relative frequency difference fdr is shown as a relative value which is obtained by dividing the difference between an actual frequency fa and the target frequency f0 (hereinafter, referred to as a "frequency difference") by the target frequency f0, and is a value in which the relative value obtained by dividing the difference between the target period T0 and the actual period Ta changing according to the transporting velocity by the target period T0 is expressed as the relative frequency difference. The target period T0 is a value which is a specified with respect to the target velocity v0 according to the type of the continuous paper P. The value is obtained and set by the actual measurement in advance.

FIG. 6 is a table illustrating an example of a relationship between an actual period Ta, a relative frequency difference fdr, and a change coefficient Kca corresponding to a relative velocity vr. In one example, the measurement results of the actual period are as follows.

Target Sheet (Continuous Paper P): Plain Paper
Target Velocity v0: 1 μm/μs
Sampling Period ts: 0.1 μs (Sampling Frequency fs: 10 MHz)
Sampling Number n is $2^{13}$ (=8192)
Shift Number p: 70
Period Number m: 125
FFT Frequency Resolution Δf: fs/n=1.22 kHz
FFT Specified Frequency fc: fq=f7=7·Δf=8.54 kHz When considering that the sampling period ts is followed by changes in the diffuse reflected light intensity in accordance with the fiber which configures the surface asperity which has a size of about 0.25 μm to 50 μM, while moving in a length corresponding to a length of a short fiber, it is preferable that the sampling period ts is set to a sampling period which is capable of taking at least two or more samples. In the present example, the sampling period ts is set to 0.1 μm. In addition, the sampling number n, the shift number p, and the period number m are appropriately set by considering the time required for the FFT and the accuracy. In addition, as the specified frequency fc, a frequency having characteristics suitable to measure the period variation in accordance with the velocity variation is set according to the type of the continuous paper P that is a target sheet.

As shown in FIG. 6, in a case where the relative velocity vr is 1, the actual period Ta in the frequency component fc of a specified frequency fq (f7) is an average value of 10 samples, and the value is 21.581. The actual period Ta is represented by a numeral value which is obtained by converting the shift width Td into a unit time.

In one example, the actual velocity va is 2% slower than the target velocity v0 and the relative velocity vr is 0.98. In this example, because the measured actual period Ta is 21.686 and the relative frequency difference fdr is −0.00484, the value of the change coefficient Kca can be obtained to be 4.13 from Expression (3) above.

In one example, the actual velocity va is 2% faster than the target velocity v0 and the relative velocity vr is 1.02. Because the measured actual period Ta is 21.466 and the relative frequency difference fdr is +0.00536, the value of the change coefficient Kca can be obtained to be 3.37 from Expression (3) above.

The same figures and descriptions can be applied to other relative velocity vr. In addition, the relative frequency difference fdr and the change coefficient Kca corresponding to each actual period Ta in a case where the target velocity v0 is 1 μm/μs are described in the present example. However, even in a case where the value of the target velocity v0 is different to the above value, the change coefficient Kca corresponding to each actual period Ta can be obtained in the same manner in the above.

As described above, in a certain target velocity v0, if the relative frequency difference fdr corresponding to the measured actual period Ta and the change coefficient Kca are obtained, the velocity change Δva and the actual velocity va can be obtained from Expressions (1) and (2) above.

The change coefficient Kca corresponding to each actual period Ta is obtained in advance such that a value corresponding to each actual period Ta which can be measured is substituted into Expression (3) above for each transporting velocity which can be set as the target velocity v0, and the obtained change coefficient may be stored in a look-up table included in the velocity detecting unit 348 (FIG. 2).

FIG. 7 is an explanatory diagram illustrating an example of a look-up table LT in which the change coefficient Kca as a relative frequency difference is stored. In the look-up table LT, the change coefficients Kca which are obtained in accordance with Expressions (3) and (4) as described above are stored in the look-up table and associated with the target velocity v0 and the actual period Ta. The look-up table can be accessed, in one example, based on the actual period Ta and the target velocity v0.

The velocity detecting unit 348 (FIG. 2) can acquire the change coefficient Kca corresponding to the target velocity v0 and the actual period Ta from the look-up table LT, in Step S140 (FIG. 3). The velocity detecting unit 348 can acquire the velocity change Δva according to Expression (2) above from the obtained change coefficient Kca, the relative frequency difference fdr, and the target velocity v0. If the value of the velocity change Δva is not zero, it can be detected that the transporting velocity (actual velocity) va of the continuous paper P is changed with respect to the target velocity v0. In addition, according to Expression (1) above, the actual velocity va in which only the velocity change Δva is changed with respect to the target velocity v0 can be obtained.

The obtained velocity change Δva or the actual velocity va is used for performing various controls of the sheet feed motor 132 in the transport control unit 120 (FIG. 2). For example, by integrating the velocity change Δva by a time where the velocity change Δva is generated, the shift of the displacement with respect to the displacement of the continuous paper P in a case where the continuous paper P is transported at the target velocity v0 can be estimated and the shift of the position of the continuous paper P can be estimated. By using this, the operation of the sheet feed motor 132 can be controlled so as to correct the shift of the stop position of the movement of the continuous paper P. In addition, the operation of the sheet feed motor 132 can be controlled so as to allow the actual velocity va to be the target velocity v0. In addition, by integrating the actual velocity va by a time where the actual velocity va is generated, the displacement of the continuous paper P which is transported at the actual velocity va can be estimated.

In the above-described transporting state detecting operation, the diffuse reflected light of the non-coherent light radiated to the continuous paper P to be transported is received from the sheet surface, and the intensity of the received diffuse reflected light is acquired for each constant period. In the array of the obtained intensity of the diffuse reflected light arranged in the time series, analyzing of the frequency component by the FFT is performed and the period (actual period) Ta of the periodic temporal changes in the real number portion of the specified frequency component is obtained.

The difference (velocity change) Δva between the transporting velocity (actual velocity) va of the continuous paper P and the target velocity v0 and the actual velocity va can be obtained based on the obtained actual period Ta and the well-known target period T0 that is a period of the periodic temporal changes in the real number portion of the specified frequency component fc in a case where the transporting velocity of the continuous paper P is the target velocity v0. Accordingly, it can be detected that the transporting velocity (actual velocity) va of the continuous paper P is changed with respect to the target velocity v0.

Here, the transporting state detecting operation of the embodiment is executed in the above-described medium transporting state detecting device 30 (FIG. 2). The irradiation optical system 310 in the medium transporting state detecting device 30 is a simple structure irradiation optical system including a light source 312 which emits the non-coherent light and the light guide unit 314 which guides the non-coherent light emitted from the light source 312 as irradiation light. The light receiving optical system 320 is configured by a light receiving optical system including the optical fiber 322, the condensing lens 324, and the photo sensor 326. Accordingly, it can be solve the problems of increasing the size and the cost of the imaging apparatus and the optical apparatus which are described in Related art. That is, by the simple structure, the changes in the transporting velocity of the continuous paper P can be detected and the real velocity (actual velocity) and the difference (velocity change) between the real velocity (actual velocity) and the target velocity and can be obtained.

The difference (velocity change) Δva between the transporting velocity (actual velocity) va of the continuous paper P and the target velocity v0 can be represented by Expression (5) below not Expression (2) above.

$$\Delta va = v0 \cdot (\mathrm{Kca} \cdot \mathrm{fdr}) = v0 \cdot \mathrm{Kcb} \tag{5}$$

Here, Kcb is the change coefficient stored as the correction coefficient indicating the ratio of the velocity change Δva with respect to the target velocity v0 and is represented by Expression (6) below.

$$\mathrm{Kcb} = \mathrm{Kca} \cdot \mathrm{fdr} = -(1 - vr) \tag{6}$$

Here, vr means the relative velocity that is a ratio of the actual velocity va to the target velocity v0 and −(1−vr) means a relative velocity difference [(va−v0)/v0] indicating the velocity change Δva (=va−v0) of the actual velocity va with respect to the target velocity v0.

In this case, a certain target velocity v0, if the change coefficient Kcb corresponding to the measured actual period Ta is obtained, the velocity change Δva can be obtained from Expression (5) above and the actual velocity va can be obtained from Expression (1) above.

In the same manner as that of the above-described change coefficient Kca, the change coefficient Kcb corresponding to each actual period Ta is obtained in advance such that a value corresponding to each actual period Ta which can be measured is substituted into Expression (6) above for each transporting velocity which can be set as the target velocity v0, and the obtained change coefficient may be stored in a look-up table included in the velocity detecting unit 348 (FIG. 2).

Figure 8:
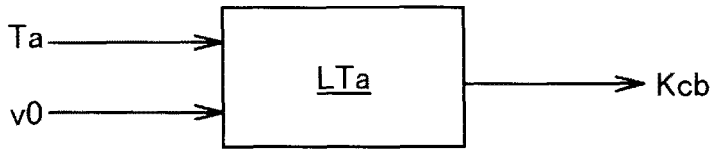
FIG. 8 is an explanatory diagram illustrating an example of a look-up table in which the change coefficient is stored as a correction coefficient.

FIG. 8 is an explanatory diagram illustrating an example of a look-up table LTa in which the change coefficient Kcb as a relative frequency difference is stored. In the look-up table LTa, the change coefficient Kcb obtained according to Expression (6) above is stored in the look-up table LTa and is associated with the target velocity v0 and the actual period Ta.

Even in this case, the velocity detecting unit 348 (FIG. 2) can obtain the change coefficient Kcb corresponding to the target velocity v0 and the actual period Ta from the look-up table LTa, in Step S140 above. The velocity detecting unit 348 can obtain the velocity change Δva according to Expression (5) above from the change coefficient Kcb and the target velocity v0In addition, the actual velocity va which is changed by the velocity change Δva with respect to the target velocity v0 can be obtained according to Expression (1) above.

In the above description, a case where the target velocity v0 and the actual period Ta are input to the look-up table, the change coefficient corresponding to the target velocity v0 and the actual period Ta is acquired from the look-up table, the velocity change Δva of the actual velocity va is obtained, and the target velocity v0 is corrected by the velocity change Δva to obtain the actual velocity va is described. Here, if the type of the sheet shaped medium that is a target and the target velocity v0 is determined, the target period T0 is a specified value and is a given value which is measured in advance. Therefore, the target period T0 and the actual period Ta may be input to the look-up table, the change coefficient corresponding to the target period T0 and the actual period Ta may be acquired, and the velocity change Δva of the actual velocity va may be obtained. That is, the velocity change Δva that is a difference between the actual velocity va and the target velocity v0 is obtained based on the actual period Ta and the target velocity v0 or the target period T0 and the actual velocity va can be obtained by correcting the target velocity v0 by the velocity change Δva.

C. Transporting State Detecting Operation of Second Embodiment

The velocity change Δva may be acquired directly from the look-up table unlike obtaining the velocity change Δva using the change coefficients Kca and Kcb as the correction coefficient which is acquired from the look-up table as described in the first embodiment. In this case, the velocity change Δva corresponding to each actual period Ta is obtained in advance such that a value corresponding to each actual period Ta which can be measured is substituted into Expressions (5) and (6) above for each transporting velocity which can be set as the target velocity v0, and the obtained change coefficient may be stored in a look-up table included in the velocity detecting unit 348 (FIG. 2).

Figure 9:
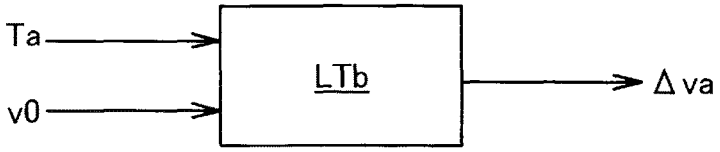
FIG. 9 is an explanatory diagram illustrating an example of the look-up table in which a velocity change is stored.

FIG. 9 is an explanatory diagram illustrating an example of a look-up table LTb in which the velocity change Δva is stored. In the look-up table LTb, the velocity change Δva which is obtained according to Expression (5) above using the change coefficient Kcb obtained according to Expression (6) above is stored in the look-up table and associated with the target velocity v0 and the actual period Ta.

The velocity detecting unit 348 (FIG. 2) acquires the velocity change Δva corresponding to the target velocity v0 and the actual period Ta from the look-up table LTb, in Step S140 of FIG. 3, and can acquire the actual velocity va which is changed by the velocity change Δva with respect to the target velocity v0 according to Expression (1) above.

In the same manner as a case of the first embodiment, the obtained velocity change Δva or the actual velocity va is used for performing various controls of the sheet feed motor 132 in the transport control unit 120 (FIG. 2).

In the present embodiment, the velocity change Δva or the transporting real velocity (actual velocity) va of the continuous paper P can be obtained based on the target period T0 and the actual period Ta.

In addition, the transporting state detecting operation of the present embodiment is also executed in the above-described medium transporting state detecting device 30 (FIG. 2). Accordingly, it can be solve the problems of increasing the size and the cost of the imaging apparatus and the optical device which are described in Related art. That is, by the simple structure, variations in the transporting velocity of the continuous paper P can be detected and the velocity change or the real velocity (actual velocity) can be obtained.

In the present embodiment, the target period T0 and the actual period Ta are input to the look-up table, and the velocity change Δva or the actual velocity va may be obtained based on the target period T0 and the actual period Ta.

D. Transporting State Detecting Operation of Third Embodiment

It is also possible to obtain the velocity change Δva that is a difference between the actual velocity va and the target velocity v0 by obtaining the actual velocity va corresponding to the target velocity v0 and the actual period Ta, which is different from obtaining the actual velocity va by correcting the target velocity v0 by the velocity change Δva by obtaining the velocity change Δva as described in the first and second embodiments.

The transporting velocity (actual velocity) va of the continuous paper P can be represented by Expression (7) below without Expression (1) above, and according to this, the velocity change Δva can be represented by Expression (8) below without Expression (2) above.

$$va=Kr\cdot v0 \tag{7}$$

$$\leftarrow va=va-v0 \tag{8}$$

Here, Kr is the change coefficient stored as the correction coefficient corresponding to the relative velocity vr that is a ratio of the velocity change Δva with respect to the target velocity v0 and is represented by Expression (9) below.

$$Kr=vr=va/v0 \tag{9}$$

In this case, in a certain target velocity v0, if the change coefficient Kr corresponding to the measured actual period Ta is obtained, the actual velocity va can be obtained from Expression (7) above and the velocity change Δva can be obtained from Expression (8) above.

In the same manner as that of the above change coefficients Kca and Kcb, the change coefficient Kr corresponding to each actual period Ta is obtained in advance such that a value corresponding to each actual period Ta which can be measured is substituted into Expression (9) above for each transporting velocity which can be set as the target velocity v0, and the obtained change coefficient may be stored in a look-up table included in the velocity detecting unit 348 (FIG. 2).

Figure 10:
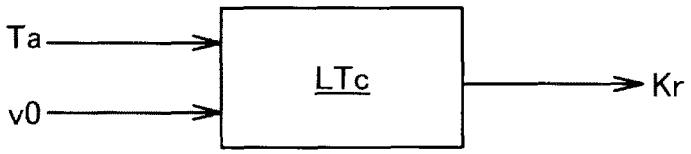
FIG. 10 is an explanatory diagram illustrating an example of a look-up table in which a change coefficient is stored as the correction coefficient.

FIG. 10 is an explanatory diagram illustrating an example of a look-up table LTc in which a change coefficient Kr as the correction coefficient is stored. In the look-up table LTc, the change coefficient Kr which is obtained according to Expression (9) above is stored in association with the target velocity v0 and the actual period Ta.

The velocity detecting unit 348 (FIG. 2) acquires the change coefficient Kr corresponding to the target velocity v0 and the actual period Ta from the look-up table LTc, in Step S140 of FIG. 3, and the actual velocity va can be obtained according to Expression (7) above. In addition, the velocity change Δva that is a difference between the actual velocity va and the target velocity v0 can be obtained according to Expression (8) above.

In the same manner as a case of the first embodiment, the obtained velocity change Δva or the actual velocity va is used for performing various controls of the sheet feed motor 132 in the transport control unit 120 (FIG. 2).

In the present embodiment as described above, the velocity change Δva or the transporting real velocity (actual velocity) va of the continuous paper P can be obtained base on the target period T0 and the actual period Ta.

In addition, the transporting state detecting operation of the present embodiment is also executed in the above-described medium transporting state detecting device 30 (FIG. 2). Accordingly, it can be solve the problems of increasing the size and the cost of the imaging device and the optical device which are described in Related art. That is, by the simple structure, variations in the transporting velocity of the continuous paper P can be detected and the velocity change or the real velocity (actual velocity) can be obtained.

In also the present embodiment, the target period T0 and the actual period Ta are input to the look-up table, and the velocity change Δva or the actual velocity va may be obtained based on the target period T0 and the actual period Ta.

E. Transporting State Detecting Operation of Fourth Embodiment

The velocity change Δva may be obtained directly from the look-up table unlike obtaining the actual velocity using the change coefficient as the correction coefficient which is acquired from the look-up table as described in the third embodiment. In this case, actual velocity va corresponding to each actual period Ta is obtained in advance such that a value corresponding to each actual period Ta which can be measured is substituted into Expressions (7) and (9) above for each transporting velocity which can be set as the target velocity v0, and the obtained change coefficient may be stored in a look-up table included in the velocity detecting unit 348 (FIG. 2).

Figure 11:
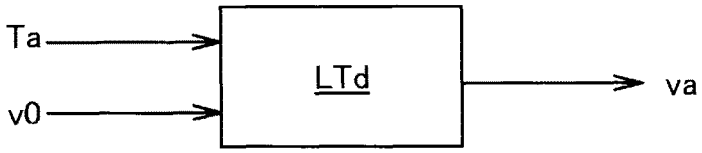
FIG. 11 is an explanatory diagram illustrating an example of a look-up table in which the actual velocity is stored.

FIG. 11 is an explanatory diagram illustrating an example of a look-up table LTd in which the actual velocity va is stored. In the look-up table LTd, the actual velocity va which is obtained according to Expression (7) above using the change coefficient Kr which is obtained according to Expression (9) above is stored in and associated with the target velocity v0 and the actual period Ta.

The velocity detecting unit 348 (FIG. 2) acquires the actual velocity va corresponding to the target velocity v0 and the actual period Ta, directly from the look-up table LTd, in Step S140 of FIG. 3, and can acquire velocity change Δva which is a difference between the actual velocity va and the target velocity v0 according to Expression (8) above.

In the same manner as a case of the third embodiment, the obtained velocity change Δva or the actual velocity va is used for performing various controls of the sheet feed motor 132 in the transport control unit 120 (FIG. 2).

In the present embodiment, the velocity change Δva or the transporting real velocity (actual velocity) va of the continuous paper P can be obtained base on the target period T0 and the actual period Ta.

In addition, the transporting state detecting operation of the present embodiment is also executed in the above-described medium transporting state detecting device 30 (FIG. 2). Accordingly, it can be solve the problems of increasing the size and the cost of the imaging device and the optical device which are described in Related art. That is, by the simple structure, variations in the transporting velocity of the continuous paper P can be detected and the velocity change or the real velocity (actual velocity) can be obtained.

In also the present embodiment, the target period T0 and the actual period Ta are input to the look-up table, and the velocity change Δva or the actual velocity va may be obtained based on the target period T0 and the actual period Ta.

F. Modification Example

The present invention is not limited to the above-described embodiments or modes, but may be embodied in various other forms without departing from the gist of the invention. For example, the following modifications are possible.

(1) In the above-described medium transporting state detecting device 30, the configuration using the irradiation optical system 310 including the light source 312 which emits the non-coherent light and the light guide unit 314 which guides the non-coherent light emitted from the light source 312 as an irradiation light the light receiving optical system 320 including the optical fiber 322, the condensing lens 324, and the photo sensor 326 is described as an example. However, it is not limited thereto, for example, as a dark field irradiation optical system, the irradiation optical system may be an irradiation optical system having a structure in which the non-coherent light is radiated onto the sheet-shape medium as an irradiation light and the irradiation optical system is disposed so as to receive the diffuse reflected light among the reflected light beams which are reflected on the medium in the light receiving optical system. In addition, the light receiving optical system may be a light receiving optical system having a structure having a view field so as to receive the diffuse reflected light which is changed according to the texture on the medium.

(2) The printing apparatus is not limited to a printer which is provided with only a printing function and may be a multifunctional peripheral. Furthermore, the printing apparatus is not limited to a serial printer and may be a line printer or a page printer.

In addition, the printing apparatus (medium transporting apparatus) may be a configuration in which the winding unit 15 and the tension roller 16 are omitted.

(3) The sheet-shaped medium is not limited to a continuous paper, and may be a cut sheet, a resin film, a resin/metal composite film (laminate film), a woven fabric, a non-woven fabric, a ceramic sheet, and the like. However, a transparent medium, a black medium, and a metallic medium are excluded.

(4) The medium transporting state detecting device is not limited to being provided in the medium transporting state detecting device, and may be provided in a processing apparatus in which processing is performed other than printing. The medium transporting state detecting device may be a device which transports a medium other than the continuous paper P. For example, the medium transporting state detecting device may be adopted on a drying device which transports the medium into a drier for dry processing. In addition, the medium transporting state detecting device may be adopted on a surface processing device which performs surface processing such as coating or surface modification on the medium. In addition, the medium transporting state detecting device may be adopted on a processing device which performs punching processing on the medium. Furthermore, the medium transporting state detecting device may be adopted on a plating device which performs electroless plating on the medium. The medium transporting state detecting device may be adopted on a circuit forming device which prints a circuit on a tape-shaped substrate. The medium transporting state detecting device may be adopted on a measuring device which acquires a measurement value such as a thickness, a surface roughness of the medium. Furthermore, the medium transporting state detecting device may be adopted on a scanning device which performs scanning on the medium.

Here, the invention is not limited to the embodiments, working examples, and modified examples described above, and the realization of various configurations is possible in a range which does not depart from the spirit of the present invention. For example, it is possible for the technical characteristics in the embodiments, working examples, and modified examples which correspond to the technical characteristics in each of the aspects according to the Summary of the Invention section to be replaced or combined as appropriate in order to solve a portion or all of the problems described above, or in order to achieve a portion of all of the effects described above. In addition, where a technical characteristic is not described as one which is essential in the present specifications, it is able to be removed as appropriate.

The entire disclosure of Japanese Patent Application No: 2015-165386, filed Aug. 25, 2015 is expressly incorporated by reference herein in its entirety.

What is claimed is:

1. A medium transporting state detecting device comprising:

an irradiation optical system which irradiates a sheet-shape medium to be transported with non-coherent light;

a light receiving optical system which receives diffuse reflected light of the non-coherent light from the medium;

a diffuse reflected light acquisition unit which acquires an intensity of the diffuse reflected light for each constant period;

a frequency component analyzing unit which performs analyzing a frequency component for each of a plurality of reflected light intensity arrays configured of arrays of an intensity in a time period where the intensity is temporally and sequentially shifted, among the intensities of the diffuse reflected light which are acquired over a plurality of periods;

a period calculating unit which obtains an actual period of a temporal change in a real number portion of a frequency component of a specified frequency among the analyzed frequency components; and a velocity detecting unit which obtains at least one of a difference between an actual velocity of the medium and a target velocity and the actual velocity based on the actual period and the target period which is a period of the temporal change in the real number portion of the frequency component of the specified frequency in a case where a transporting velocity of the medium is the target velocity.

2. The medium transporting state detecting device according to claim 1, wherein the velocity detecting unit obtains the difference between the actual velocity and the target velocity based on the target period and the actual period and corrects the target velocity by the difference to obtain the actual velocity.

3. The medium transporting state detecting device according to claim 1, wherein the velocity detecting unit includes a look-up table which receives an input of the target velocity and the actual period and outputs a correction coefficient in accordance with the target velocity and the actual period, and obtains the difference between the actual velocity and the target velocity, or the actual velocity by a calculation using the correction coefficient and the target velocity.

4. The medium transporting state detecting device according to claim 1, wherein the velocity detecting unit includes a look-up table which receives an input of the target velocity and the actual period and outputs the difference between the actual velocity and the target velocity, or the actual velocity.

5. A printing apparatus comprising:

the medium transporting state detecting device according to claim 1; and a printing section which performs printing on the medium.

6. A printing apparatus comprising:

the medium transporting state detecting device according to claim 2; and a printing section which performs printing on the medium.

7. A printing apparatus comprising:

the medium transporting state detecting device according to claim 3; and a printing section which performs printing on the medium.

8. A printing apparatus comprising:

the medium transporting state detecting device according to claim 4; and a printing section which performs printing on the medium.

* * * * *